US010407837B2

(12) United States Patent
Halahmi et al.

(10) Patent No.: US 10,407,837 B2
(45) Date of Patent: Sep. 10, 2019

(54) PAVEMENT SYSTEMS WITH GEOCELL AND GEOGRID

(71) Applicant: R.F.G. TRADING LTD., Tel Aviv (IL)

(72) Inventors: Izhar Halahmi, Hod-hasharon (IL); Oded Erez, Tel Aviv (IL); Offer Avraham Zvi Kief, Haifa (IL)

(73) Assignee: GEOTECH TECHNOLOGIES LTD., Tel Aviv (IL)

( * ) Notice: Subject to any disclaimer, the term of this patent is extended or adjusted under 35 U.S.C. 154(b) by 0 days.

(21) Appl. No.: 15/025,347

(22) PCT Filed: Sep. 30, 2014

(86) PCT No.: PCT/IB2014/002807
§ 371 (c)(1),
(2) Date: Mar. 28, 2016

(87) PCT Pub. No.: WO2015/044792
PCT Pub. Date: Apr. 2, 2015

(65) Prior Publication Data

US 2016/0230353 A1 Aug. 11, 2016

Related U.S. Application Data

(60) Provisional application No. 61/884,231, filed on Sep. 30, 2013.

(51) Int. Cl.
*E01C 3/00* (2006.01)
*E01C 3/04* (2006.01)

(52) U.S. Cl.
CPC ..... *E01C 3/003* (2013.01); *E01C 3/006* (2013.01); *E01C 3/04* (2013.01)

(58) Field of Classification Search
CPC ..... E01C 3/003; E01C 3/006; E01C 3/04
(Continued)

(56) References Cited

U.S. PATENT DOCUMENTS 5,735,640 A 4/1998 Meyer et al.
5,851,089 A 12/1998 Beretta
(Continued)

FOREIGN PATENT DOCUMENTS

CN 201952698 U 8/2011

OTHER PUBLICATIONS

International Search Report dated May 18, 2015 in PCT/IB2014/002804.

*Primary Examiner* — Raymond W Addie
(74) *Attorney, Agent, or Firm* — Fay Sharpe LLP

(57) ABSTRACT

Certain pavement systems and methods for paving are suitable for locations containing a generally weak subgrade with a California Bearing Ratio of four (4) or lower. The pavement system includes a first geogrid layer placed directly on the subgrade; a first granular layer upon the first geogrid layer, the first granular layer having a thickness of from 0.5 times to 20 times the aperture distance of the geogrid layer; a first geocell layer upon the first granular layer comprising a geocell and an infill material; and a capping layer over the geocell layer. A second geocell/geogrid layer can be placed beneath the capping layer if desired. An optional surface layer may be applied upon the capping layer if desired. The resulting pavement system provides long-term support for pavements applied over the pavement system.

18 Claims, 6 Drawing Sheets

(58) Field of Classification Search
USPC ..... 404/17, 18, 27, 28, 30, 31, 72, 75; 405/302.4, 302.6
See application file for complete search history.

(56) References Cited

U.S. PATENT DOCUMENTS

| | | | | |
|---|---|---|---|---|
| 5,965,467 | A * | 10/1999 | Stevenson | D03D 9/00 405/129.75 |
| 8,790,036 | B2 * | 7/2014 | Halahmi | E02D 17/202 404/28 |
| 2004/0067103 | A1 | 4/2004 | Hart | |
| 2009/0142542 | A1 | 6/2009 | Halahmi et al. | |
| 2010/0080659 | A1 | 4/2010 | Halahmi et al. | |
| 2011/0217117 | A1 * | 9/2011 | Halahmi | E02D 17/202 404/31 |
| 2013/0209178 | A1 | 8/2013 | Erez et al. | |

* cited by examiner

PAVEMENT SYSTEMS WITH GEOCELL AND GEOGRID

CROSS-REFERENCE TO RELATED APPLICATIONS

This application claims priority to U.S. Provisional Patent Application Ser. No. 61/884,231, filed Sep. 30, 2013, the entirety of which is incorporated by reference.

BACKGROUND

The present disclosure relates to pavement systems that are suitable for use on weak subgrade, or native soil, or expansive clays, or soils susceptible to frost heaving during cold seasons. These pavement systems are located over the subgrade, and are used in various applications, such as roads, parkways, walkways, and railways. These pavement systems are especially suited for weak subgrades.

In transport engineering, several layers are recognized in the construction of a pavement. These layers include the subgrade layer, the sub-base layer, the base layer, and the surface layer. The subgrade layer is the native material and acts as the foundation for the pavement. The optional sub-base layer is laid over the subgrade. The sub-base and base layers are used to carry load and dissipate it to a level acceptable for the surface layer. Depending on the desired use of the pavement, another layer can be placed over the base layer, and this layer may be known as a paver base layer. The surface layer is then placed on top of this, and is the exposed layer on the surface of the pavement. The surface layer can be, for example, asphalt (e.g. a road or parking lot), or concrete (e.g. a sidewalk), or ballast (e.g. upon which railway rails are then laid), or compacted granular material (unpaved road).

A weak subgrade is a subgrade that has a California Bearing Ratio (CBR) of 4 or lower, or more typically 3 or lower, when measured when saturated with water. Weak subgrades have low stiffness and low resistance to load. Specific weak subgrades include those where the subgrade is an expansive clay or soil susceptible to frost-heaving during cold seasons. Frost heaving is an upwards swelling of soil caused by the formation of ice below the surface. The presence of water causes a few processes to occur that can be very damaging to pavements. First, the water molecules can swell the soil particles and lower the cohesion between them. Second, swelling by water can cause expansion of the soil, increasing pressure upwards on the pavement above. Third, the water expands during freezing, and in combination with hardening due to ice formation, can damage the pavement. These upwards stresses generated during expansion (e.g. swelling of the clay or the soil) can be significantly greater than those generated by traffic on soft subgrades. Pavements that are installed on such weak subgrade can fail prematurely.

In many situations where the subgrade is weak, and the subgrade is shallow, the subgrade is removed and replaced with stronger and more dimensionally stable granular materials. However, in other situations this is impossible due to: (a) the soft soil of the subgrade being too deep; or (b) stronger and more dimensionally stable granular materials not being available locally, or the cost of shipment of such materials being too high. Examples of these situations can be found in peat ponds in northern Russia, expansive clay beds in Texas, and muskeg beds in Canada and Siberia.

An example of a pavement is shown in FIG. 1. The pavement here includes a weak subgrade 2, a crushed stone base 4, and a surface layer 6. Again, the weak subgrade can be due to soft soil, expansive clay, or frost-susceptible soil. Typical failures include rutting (formation of a groove or rut in the pavement), cracking in the asphalt or concrete surface layer of the pavement, distortion or misalignment of railway rails laid on ballast, and pumping out of the base layer underneath the surface layer. These failure modes are caused by irreversible deformations to the base and/or sub-base due to the lack of (1) tensile strength; (2) stiffness (modulus); (3) interfacial strength between layer and subgrade; and/or (4) bending moment (resistance to bending).

One method commonly employed to prevent these failure modes includes the chemical modification of the subgrade. The subgrade is mixed with an inorganic binder (e.g. lime, cement or fly ash) or an organic binder (e.g. a polymer emulsion). However, this method is subject to several undesirable characteristics such as: slow curing, poor performance when applied in wet and cold climates, leaching of inorganic binders in wet climate, high cost of polymeric binders, brittleness, poor quality due to difficulty in field mixing, poor resistance to freeze-thaw cycles, and difficulty in obtaining a homogeneous subgrade over large areas (e.g. in texture or composition).

It would be desirable to provide pavement systems that have improved performance when installed over a weak subgrade, or native soils, or expansive clays, or frost-susceptible soils. It would also be desirable for such pavement systems to be constructed in an economical and easy to install method.

BRIEF SUMMARY

Disclosed in various embodiments are pavement systems and methods for installing such pavement systems over a weak subgrade having a CBR of 4 or lower, such as expansive clays, or soils susceptible to frost heaving. The pavement systems generally include a geogrid layer upon the subgrade, a first granular layer, and a geocell layer. The first granular layer has a specified thickness or height. A surface layer can be applied directly over the geocell layer, or additional geocell or geogrid reinforced layers may be placed upon the geocell layer before the surface layer is applied.

Disclosed in some embodiments is a pavement system to be installed over a weak subgrade having a California Bearing Ratio (CBR) of 4 or lower, especially over expansive clays, or over frost-susceptible soils, comprising: a first geogrid layer placed on the subgrade and made of at least one geogrid, each geogrid being made from rib members that intersect to form geogrid apertures; a first granular layer placed upon the first geogrid layer and comprising a first granular material, the first granular layer having an average thickness of from 0.5 times to 20 times an aperture distance of the geogrid layer; a first geocell layer placed upon the first granular layer and comprising at least one geocell and that is filled with an infill material; and optionally a capping layer placed upon the first geocell layer and made from a compacted second granular material.

The pavement system may further comprise a surface layer placed upon the optional capping layer or over the first geocell layer, the surface layer comprising granular material, asphalt or concrete or ballast. In some embodiments, railway rails and ties are installed over the pavement system.

The first granular material may be sand, gravel, or crushed stone. Generally, the first granular material also enters the geogrid apertures of the first geogrid layer.

The infill material may be sand, crushed stone, gravel, or mixtures thereof.

The second granular material of the optional capping layer may be sand, gravel, or crushed stone.

The geogrid aperture distance may be from about 10 millimeters to about 500 millimeters, including from about 25 millimeters to about 100 millimeters.

The first geocell layer may have a cell height of from about 50 millimeters to about 300 millimeters. The first geocell layer may have a cell size of from about 200 millimeters to about 600 millimeters.

The at least one geogrid may be made of a polypropylene, polyethylene, polyester, polyamide, aramids, carbon fiber, textile, metal wire or mesh, glass fiber, fiber-reinforced plastics, multilayer plastic laminates, or polycarbonate.

In some embodiments, the first granular material has a higher average particle size than the infill material inside the first geocell layer.

In some further embodiments, the pavement system further comprises: a optional secondary granular layer placed upon the first geocell layer; and a second geocell layer or a second geogrid layer placed upon the secondary granular layer or over the first geocell layer; wherein the capping layer is placed over the second geocell layer or the second geogrid layer. The secondary granular layer may have a thickness of about 1 mm to about 300 mm.

In other further embodiments, the pavement system further comprises a second geocell layer or a second geogrid layer placed directly upon the first geocell layer; wherein the capping layer is placed over the second geocell layer or the second geogrid layer.

In other contemplated embodiments, a geotextile layer may be placed in any location between the subgrade and the capping layer. Such a layer may be particularly useful if the pavement is used in a location that has a high water table or receives heavy rains or floods, or where fines may infiltrate upwards or downwards between layers.

Also disclosed are methods for installing a pavement system over a weak subgrade having a California Bearing Ratio (CBR) of 4 or lower, such as expansive clays, or soils susceptible to frost heaving, comprising: applying at least one geogrid to the subgrade to form a geogrid layer, each geogrid being made from rib members that intersect to form geogrid apertures; applying a sufficient amount of a first granular material over the geogrid layer and then compacting the first granular material to form a first granular layer that has an average thickness of from 0.5 times to 20 times an aperture distance of the geogrid layer; placing at least one geocell upon the first granular layer; filling the at least one geocell with an infill material to form a first geocell layer; optionally applying a second granular material over the first geocell layer and compacting the second granular material to form a capping layer upon the geocell layer, the capping layer having a thickness of zero to about 500 mm. Optionally, a second geogrid or geocell layer can be placed directly on first geocell layer, or separated from the first geocell layer by a secondary granular layer made from a granular material.

The method may further comprise the step of applying a surface layer over the capping layer, the surface layer comprising asphalt or concrete or ballast. The method may further comprise removing soil to expose the weak subgrade.

In particular embodiments, the method also comprises: forming a secondary granular layer upon the geocell layer; and placing another geocell or geogrid upon the secondary granular layer/over the first geocell layer to form a second geocell layer or a second geogrid layer under the capping layer. The second geocell layer or second geogrid layer may be spaced apart from the first geocell layer by a distance of zero to about 500 mm.

Also disclosed is an improved pavement system, suitable for long term performance over relatively weak subgrade, said pavement system comprising in sequence from bottom to top: a subgrade having a CBR of lower than 4; a geogrid, placed directly on the subgrade, or combined within a layer of granular material; a layer of granular material on top of the geogrid, said layer thickness varying from 0.5 time to 20 times a geogrid aperture distance; a geocell, infilled with sand, crushed stone, gravel, ash, recycled asphalt pavement (RAP), quarry screenings or mixtures thereof; optionally another layer of granular material upon which is placed a second geocell or a second geogrid; a capping layer made from compacted crushed stone, gravel, or sand; and optionally, an asphalt- or concrete- or ballast-based surface layer.

These and other non-limiting aspects of the disclosure are described in more detail below.

DESCRIPTION OF THE FIGURES

The following is a brief description of the drawings, which are presented for the purposes of illustrating the exemplary embodiments disclosed herein and not for the purposes of limiting the same.

DETAILED DESCRIPTION

Figure 1:
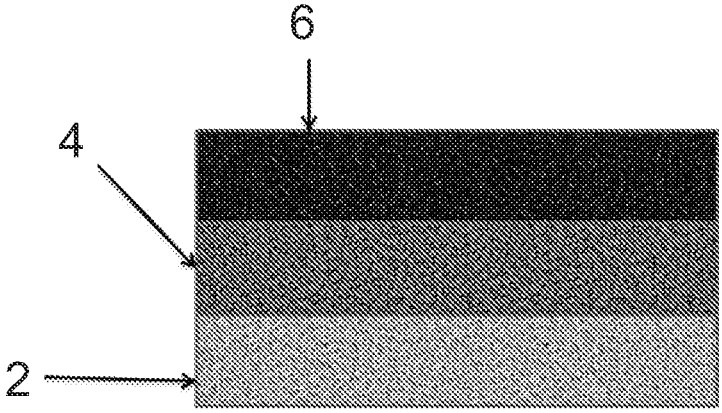
FIG. 1 is a cross-sectional view of a conventional pavement system that does not include a geocell layer or a geogrid layer.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 mm to 10 mm" is inclusive of the endpoints, 2 mm and 10 mm, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4."

When the California Bearing Ratio (CBR) is referred to herein, the value provided is measured when the layer is saturated with water.

The present application refers to pavement systems which are located in the ground. The application also refers to different layers being located "upon" or "on" or "over" each other. When a second layer is described as being located relative to a first layer using these terms, the first layer is located deeper in the ground than the second layer, or put another way the second layer is closer to the surface than the first layer. There is no requirement that the first layer and the second layer directly contact each other; it is possible for another layer to be located between them. In addition, each layer has a length, a width, and a height/depth/thickness. The length and width will refer to the dimensions of the layer in the ground. The terms height, depth, and thickness will be used interchangeably to refer to the vertical dimension of the layer.

Geogrids have been employed to remedy the failure modes described above. A geogrid can be made from polymers (e.g. polyester yarn or extruded polymer) which are arranged in a network of ribs and apertures to provide uniaxial or biaxial tensile reinforcement to soil. The geogrid can include a coating that provides further chemical and mechanical benefits. Alternatively, a sheet can be punched and then drawn to form a geogrid, as is done by Tensar Corporation. Polyester or polypropylene rods or straps can also be laser heated or ultrasonically bonded together in a gridlike pattern to form a geogrid. A geogrid is generally mechanically and chemically durable, so that it can be installed in aggressive soil or in aqueous environments. A geogrid is a two-dimensional structure and lacks an effective height, and has a flat planar structure.

Geocells have also been incorporated into pavement systems to prevent failure modes. A geocell (also known as a cellular confinement system (CCS)) is an array of containment cells resembling a "honeycomb" structure that is filled with infill. CCSs are three-dimensional structures with internal force vectors acting within each cell against all the walls, whereas geogrids are only two-dimensional. However, when a geocell is used to reinforce the base or sub-base over a weak subgrade, the pavement may still fail, due to "flow" of the infill out of the bottom of the geocell and downwards towards the weak subgrade, and due to insufficient tensile strength. This causes an undesired difference in modulus and tensile strength between the base/sub-base and the subgrade, and poor tensile performance along the interface thereof.

There have been studies of combining geocells and geogrids within a common pavement system. For example, one system has placed a geogrid in the subgrade layer, then placed a geocell directly upon the geogrid-reinforced subgrade layer (i.e in the sub-base) and filled the geocell with excavated material. These layers are then compacted and topped with a layer of clean stone (0.75 inches in height). However, this system using a geogrid subgrade layer with a geocell overlayer only partially solve the identified problems relating to failure modes of pavement systems. Due to the high stiffness of the geocell layer, the geogrid-reinforced layer is subjected to low strains. Because geogrids require significant deformation in order to contribute significant tensile reinforcement, the geogrid is thus unable to provide notable reinforcement to the overall system.

The present application therefore relates to improved pavement systems, suitable for long term performance over a weak subgrade that has a California Bearing Ratio (CBR) of 4 or lower, or over expansive clays, or over a soil that is susceptible to frost heaving (i.e. a frost-susceptible soil). These soils may include organic clays, peat, muskeg, montmorillonite soils, and bentonite soils. The pavement systems of the present disclosure include a geogrid-reinforced layer that is spaced from a geocell-reinforced layer by a layer of granular material. Another geogrid layer or geocell layer can be placed on top of the original geocell-reinforced layer. These systems are very suitable for use where stresses are also exerted from below the pavement (i.e. upwards).

Geocells (also known as cellular confinement systems (CCS)) are a three-dimensional geosynthetic product which are useful in many geotechnical applications such as soil erosion prevention, channel lining, construction of reinforced soil retaining walls, and support of pavements. A CCS is an array of containment cells resembling a "honeycomb" structure that is filled with infill, which can be cohesionless soil, sand, gravel, ballast, or any other type of aggregate. CCSs are used in civil engineering applications to prevent erosion or provide lateral support, such as retaining walls for soil, alternatives for sandbag walls or gravity walls, and for roadway, pavement, and railway foundations. Geogrids are generally flat (i.e., two-dimensional) and used as planar reinforcement, whereas CCSs are three-dimensional structures with internal force vectors acting within each cell against all the walls. CCSs also provide efficient reinforcement for relatively fine infills, such as sand, loam, and quarry waste.

Figure 2:
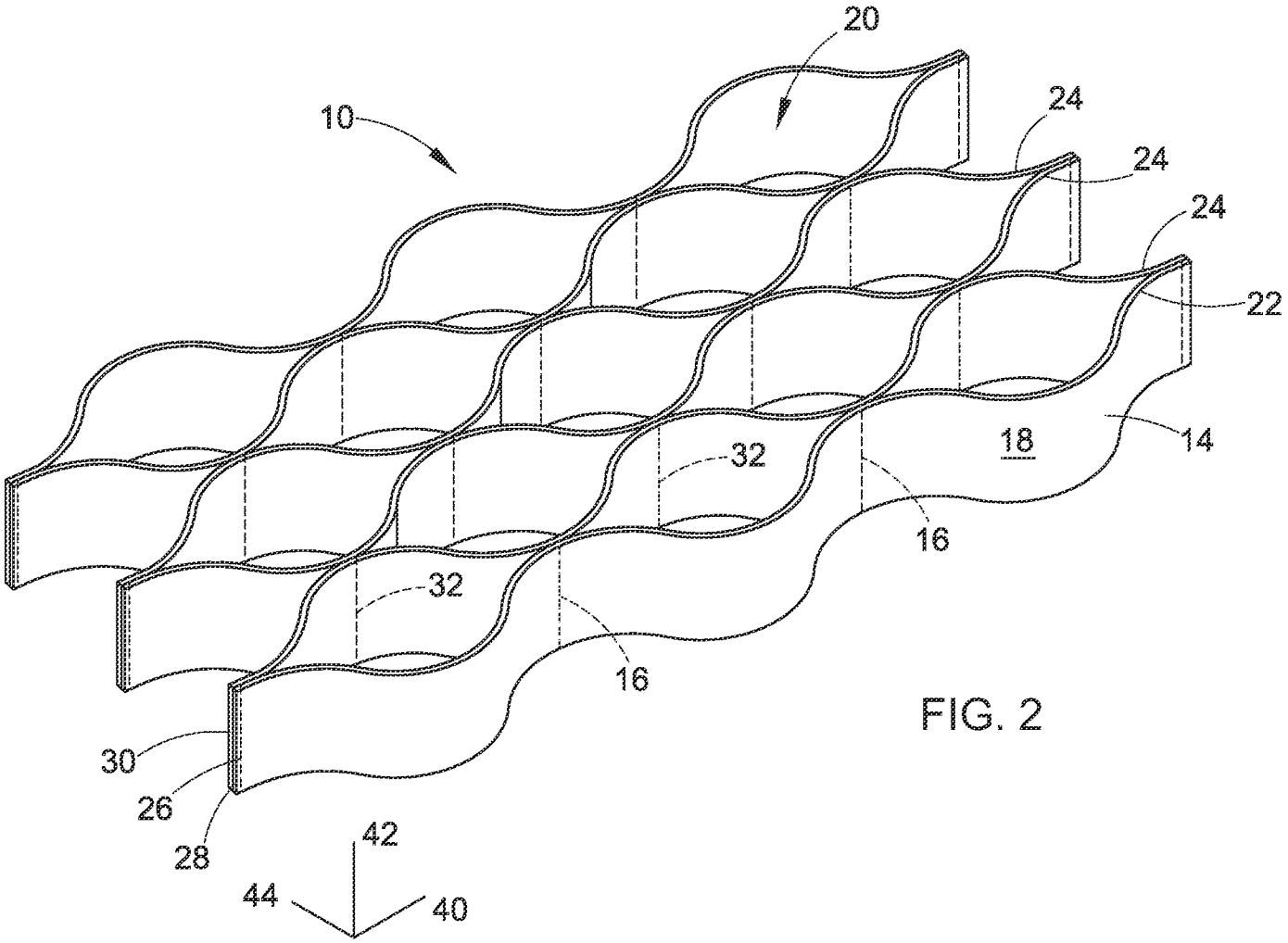
FIG. 2 is a perspective view of a geocell in its expanded state.

FIG. 2 is a perspective view of a geocell in its expanded state. The geocell 10 comprises a plurality of polymeric strips 14. Adjacent strips are bonded together along discrete physical seams 16. The bonding may be performing by bonding, sewing or welding, but is generally done by welding. The portion of each strip between two seams 16 forms a cell wall 18 of an individual cell 20. Each cell 20 has cell walls made from two different polymeric strips. The strips 14 are bonded together so that when expanded, a honeycomb pattern is formed from the plurality of strips. For example, outside strip 22 and inside strip 24 are bonded together at seams 16 which are regularly spaced along the length of strips 22 and 24. A pair of inside strips 24 is bonded together along seams 32. Each seam 32 is between two seams 16. As a result, when the plurality of strips 14 is stretched or expanded in a direction perpendicular to the faces of the strips, the strips bend in a sinusoidal manner to form the geocell 10. At the edge of the geocell where the ends of two polymeric strips 22, 24 meet, an end weld 26 (also considered a joint) is made a short distance from the end 28 to form a short tail 30 which stabilizes the two polymeric strips 22, 24. This geocell may also be referred to as a section, particularly when combined with other geocells over a larger area than could be practically covered by a single section.

Figure 3:
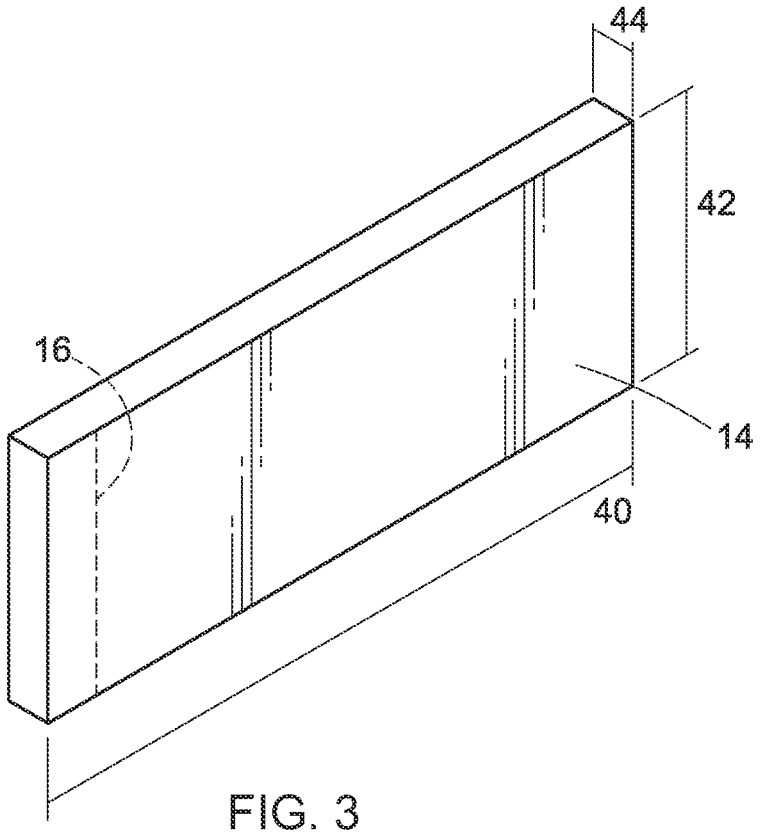
FIG. 3 is an enlarged perspective view of a polymeric strip of the geocell of FIG. 2.

FIG. 3 is a close-up perspective view of a polymeric strip 14 showing the length 40, height 42, and width 44, with a seam 16 illustrated for reference. The length 40, height 42, and width 44 are measured in the direction indicated. The length is measured when the geocell is in its folded or compressed state. In the compressed state, each cell 20 may be considered to have no volume, whereas the expanded state generally refers to when the geocell has been expanded to its maximum possible capacity. In embodiments, the geocell height 43 is from about 50 millimeters (mm) to about 300 mm. The geocell cell size (measured as the distance between seams in the un-folded state) can be from about 200 mm to about 600 mm.

The geocells can be made from linear low density polyethylene (PE), medium density polyethylene (MDPE) and/or high density polyethylene (HDPE). The term "HDPE" refers hereinafter to a polyethylene characterized by density of greater than 0.940 g/cm$^3$. The term medium density polyethylene (MDPE) refers to a polyethylene characterized by density of greater than 0.925 g/cm$^3$ to 0.940 g/cm$^3$. The term linear low density polyethylene (LLDPE) refers to a polyethylene characterized by density of 0.91 to 0.925 g/cm$^3$. The geocells can also be made from polypropylene, polyamide, polyester, polystyrene, natural fibers, woven textile, blends of polyolefins with other polymers, polycarbonate, fiber-reinforced plastic, textile, or multilayer plastic laminate. The strips used to make the geocell are welded together in an offset manner, with the distance between welded seams being from about 200 mm to about 600 mm.

The usual strip wall width for a geocell is 1.27 millimeters (mm), with some variation in the range of 0.9 mm to 1.7 mm. The cell walls can be perforated and/or embossed.

Figure 4:
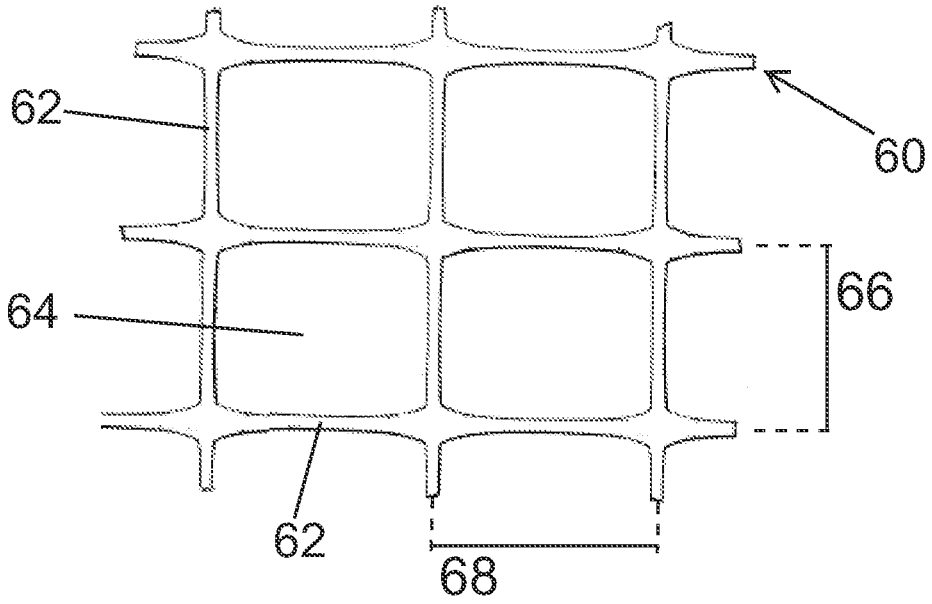
FIG. 4 is a plan view of a portion of a geogrid.

FIG. 4 is a magnified plan view of a portion of a geogrid 60. The geogrid is made from rib members 62 that intersect each other to define geogrid apertures 64. The geogrid can be made of polypropylene, polyethylene polyester, polyamide, aramids (e.g. KEVLAR), carbon fiber, textile, metal wire or mesh, glass fiber, fiber-reinforced plastics (e.g. blends or alloys), multilayer plastic laminates, or polycarbonate. As shown here, the geogrid apertures are rectangular, but the geogrid apertures can generally be any shape, including square, triangular, circular, etc. Any geometry can be used. The rib members are less than 50% of the geogrid area, or put another way the open area of the geogrid is greater than 50%.

Each geogrid aperture has an aperture distance, which is the average length of the ribs surrounding the aperture. As illustrated here, for example, in a rectangular aperture the aperture distance is the average length of the shorter rib member 66 and the longer rib member 68. In embodiments, the aperture distance for a geogrid is from about 10 mm to about 500 mm, or from about 25 mm to about 100 mm.

A geocell and a geogrid can be distinguished by the height of their respective strip and rib member. A geocell has a height of at least 20 mm, whereas a geogrid has a height of from about 0.5 mm to 2 mm.

Figure 5:
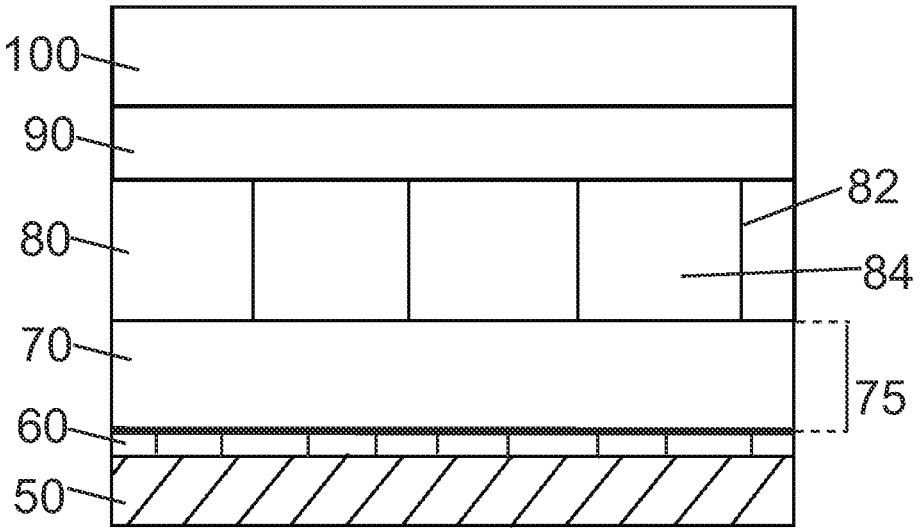
FIG. 5 illustrates a pavement system of the present disclosure, having a geogrid layer and a geocell layer.

FIG. 5 is a cross-sectional view of an exemplary pavement system of the present disclosure. Generally, a geogrid-reinforced layer is spaced from a geocell-reinforced layer by a layer of granular material.

Initially, a geogrid layer 60 is formed on the subgrade layer 50. The geogrid layer is formed from at least one geogrid. It is noted that the subgrade may be the native subgrade, or may be chemically modified (e.g. with lime, cement, polymer, or fly ash), or may be physically modified (e.g replaced with a more stable granular material). The modified portion of the subgrade may have a thickness that varies from about 50 mm to about 1000 mm.

Next, a first granular layer 70 is placed on the geogrid layer 60. The first granular layer comprises a first granular material, which can be sand, gravel, or crushed stone. The first granular layer has a thickness 75 of from 0.5 times to 20 times the aperture distance of the geogrid layer. It is noted that the first granular material can fall into/enter the geogrid apertures of the geogrid layer 60. If desired, the first granular layer is compacted.

The aperture distance of the geogrid layer is usually the same as the aperture distance of the geogrids that make up the geogrid layer, assuming that all of the geogrids are the same. In the event that different geogrids with different aperture distances are used in the geogrid layer, the aperture distance of the geogrid layer should be calculated as the average aperture distance, weighted by the surface area covered by each geogrid.

Next, a geocell layer 80 is placed on the first granular layer 70. The geocell layer is formed from at least one geocell 82, which is filled with an infill material 84. The infill material is compacted to stiffen the infill. Exemplary infill material includes sand, crushed stone, gravel, and mixtures thereof. Other finer grade granular materials can also be included in the infill material if desired. In this regard, in some embodiments, the first granular material of the first granular layer has a higher average particle size compared to the average particle size of the infill material.

The combination of the geogrid layer 60 with the first granular layer 70 is needed to develop tensile and shear forces, and for the proper performance of the geocell layer 80. The combination of the geogrid layer and the first granular layer provides: (1) a stiff and impermeable "floor" that allows the development of high stiffness in the geocell layer during compaction of the infill material; (2) a barrier against infilling of fines from the subgrade upwards into the geocell layer; (3) an interface for high shear forces; and (4) mechanical separation between the subgrade and the geocell layer, allowing the geocell layer to perform as a stiff and elastic beam while restricting its strains to the elastic range.

Optionally, a capping layer 90 is then placed above the geocell layer 80. This layer is formed from compacted materials, such as crushed stone, gravel, or sand. This layer may be considered as being made from a second granular material.

Optionally, a surface layer 100 can be placed on the capping layer 90 that is distributed above the geocell reinforced layer 80. The surface layer can include asphalt or concrete or ballast.

This design allows the geogrid layer 60 to deform, so that the geogrid layer can stiffen and reinforce the first granular layer 70 located below the geocell layer 80. This configuration significantly lowers the stresses and deformations that are passed to the subgrade 50 and the interface between the subgrade and the sub-base. The geogrid layer 60 and the first granular layer 70 also provide a stiff foundation for the geocell layer 80 by improving the tensile strength and shear strength performance of the uppermost zone of the subgrade 50. The geogrid layer 60 increases the fatigue resistance of the subgrade and helps to reduce the downward "leakage" of infill from the geocell layer during the service lifetime of the pavement system. To be clear, the first granular layer 70 separates the geogrid layer 60 from the geocell layer 80; the geogrid and geocell do not contact each other when being assembled.

The geocell layer 80 functions as a rigid and stiff mattress that distributes stresses over a wide area of the pavement system and helps to avoid local over-stresses. These local over-stresses are a major cause for failure in pavement systems installed over weak subgrade. The infill material can be sand, gravel, or crushed stone, or mixtures thereof.

A synergistic relationship is created between the geogrid layer and the geocell layer when spaced apart by the first granular layer. The geogrid layer 60 is positioned below the geocell layer 80 at a distance allowing sufficient deformation along the geogrid layer, so that it can provide tensile stiffening to the subgrade against stresses generated by expansion of the subgrade. The design of the present disclosure is capable of absorbing large mechanical stresses, elastically, with high fatigue resistance. In particular, the pavement systems of the present disclosure display improved resistance to multiple mechanical cyclic loadings, to multiple expansion-contraction events of subgrade, and to freeze-thaw cycles over a long period of time.

Without being bound by theory, it is believed that placing only one or more geogrid layers over the subgrade would not successfully strength the subgrade sufficiently due to (1) insufficient bending moment; and (2) insufficient stiffness of the geogrid layers. Similarly, using only a geocell layer over the subgrade would be unsuccessful, due to (1) insufficient tensile strength; and (2) the tendency of the infill to yield upwards/downwards due to pressure applied by traffic or the expansion-contraction of the soil.

The disclosure also includes methods for installing the pavement systems over a weak subgrade. Generally, soil is removed to expose the weak subgrade. Next, at least one geogrid is applied to the subgrade to form the geogrid layer. A sufficient amount of a first granular material is then applied over the geogrid layer to form the first granular layer that has an average thickness of from 0.5 times to 20 times an aperture distance of the geogrid layer. At least one geocell is placed upon the first granular layer, and then is filled with an infill material to form the geocell layer. A second granular material is applied over the geocell layer, and then compressed to form the capping layer upon the geocell layer. If desired, a surface layer is then applied over the capping layer.

Figure 6:
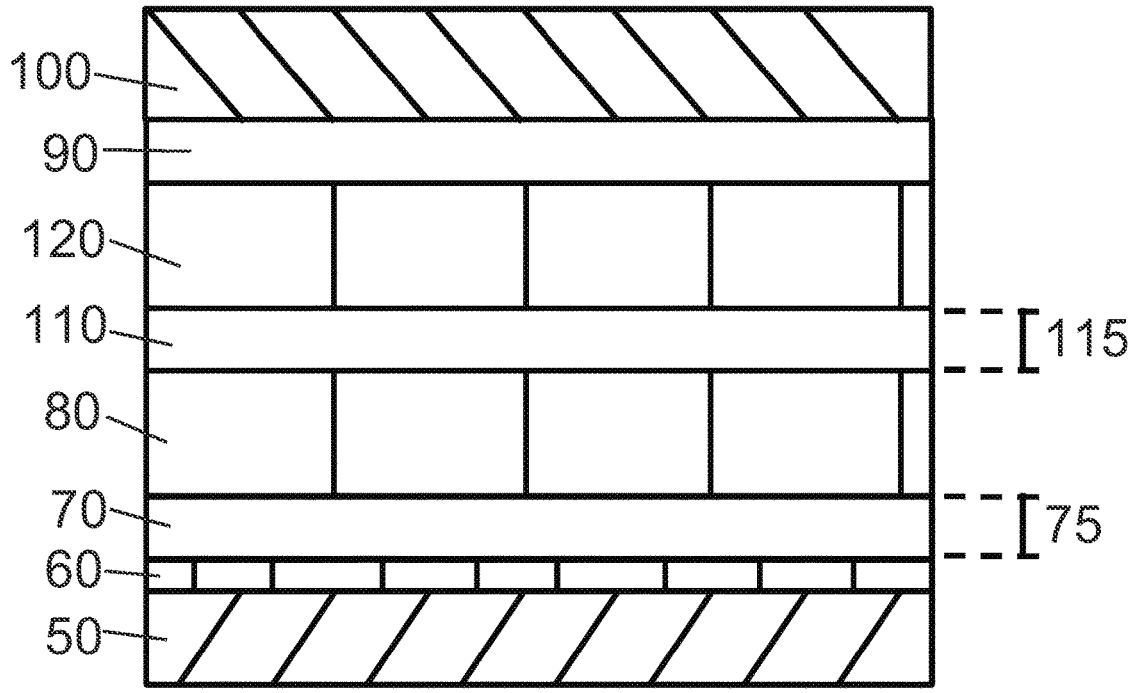
FIG. 6 illustrates another pavement system, having a geogrid layer, then a first geocell layer, then a second geocell layer above the first geocell layer.
Figure 7:
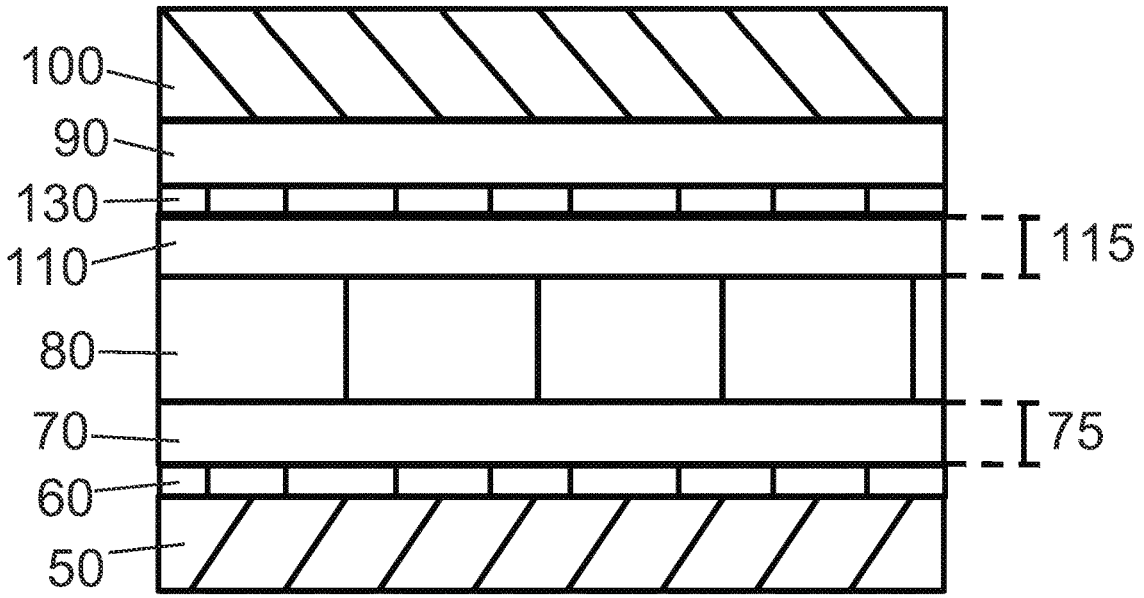
FIG. 7 illustrates another pavement system, having a first geogrid layer, then a geocell layer, then a second geogrid layer above the geocell layer.

FIG. 6 and FIG. 7 are cross-sectional views of two additional embodiments of pavement systems that include additional layers.

In FIG. 6, the pavement system includes a geogrid layer 60 formed on the subgrade layer 50, a first granular layer 70 placed on the geogrid layer 60, and a geocell layer 80 placed on the first granular layer 70, as described above. The first granular layer 70 has a thickness 75. A secondary granular layer 110 is then placed on the geocell layer 80. This secondary granular layer may be made from the same material as the first granular layer 70 or the infill of the geocell layer. The secondary granular layer can be considered as being formed from a third granular material (as described above, the capping layer is formed from a second granular material). The secondary granular layer has a thickness 115, which can be from about 10 mm to about 500 mm. A second geocell layer 120 is then placed upon the secondary granular layer 110. This second geocell layer is also formed from at least one geocell and filled with infill material, as described above with respect to the geocell layer 80. A capping layer 90 is then placed above the second geocell layer 120, and optionally a surface layer 100 can be placed on the capping layer 90. The capping layer and surface layer may be made as described above in FIG. 5. The second geocell layer 120 provides additional tensile strength to the system, resisting bending from the subgrade that may occur during expansion of clay or the freeze-thaw cycle.

In FIG. 7, the pavement system includes a geogrid layer 60 formed on the subgrade layer 50, a first granular layer 70 placed on the geogrid layer 60, and a geocell layer 80 placed on the first granular layer 70, as described above. The first granular layer 70 has a thickness 75. A secondary granular layer 110 is then placed on the geocell layer 80, which has a composition as described above. The secondary granular layer has a thickness 115, which can be from about 1 mm to about 300 mm. A second geogrid layer 130 is then placed upon the secondary granular layer 110. The second geogrid layer is formed from at least one geogrid. A capping layer 90 is then placed above the second geogrid layer 130, and optionally a surface layer 100 can be placed on the capping layer 90. The capping layer and surface layer may be made as described above in FIG. 5. The material used to form the capping layer may fall into the apertures of the second geogrid layer 130. The second geogrid layer 130 also provides additional tensile strength to the system, resisting bending from the subgrade that may occur during expansion of clay or the freeze-thaw cycle.

In other contemplated embodiments, the second geogrid layer or second geocell layer can be placed directly upon the first geocell layer after the infill in the first geocell layer has been compacted. No secondary granular layer is needed. The distance between the first geocell layer and the second geogrid layer or second geocell layer can thus be adjusted from almost zero, to about 500 millimeters as needed to obtain the desired total pavement modulus and fatigue resistance.

In addition, as desired, a geotextile layer can be placed anywhere in the pavement system between the subgrade and the top layer of the system (i.e. the geotextile layer is never the uppermost layer of the system). A geotextile is a two-dimensional permeable fabric that can be woven or non-woven, and is used to avoid loss or penetration of fines up to the surface of the pavement. A geotextile can be distinguished from a geogrid because the apertures of a geogrid are large enough to allow for soil strike-through from one side of the geogrid to the other, whereas a geotextile does not allow for soil strike-through. The geotextile layer is desirably used in areas that are subject to floods, heavy rains, or that have a high water table. The geotextile layer can be made from a fabric that has a specific weight of 50 grams per square meter ($g/m^2$) to 3000 $g/m^2$.

The present disclosure will further be illustrated in the following non-limiting working example, it being understood that these example is intended to be illustrative only and that the disclosure is not intended to be limited to the materials, conditions, process parameters and the like recited herein.

EXAMPLE

A railway trail ran over a subgrade of expansive clay having a CBR of 3 when saturated with water. Trail maintenance was required periodically, and the train speed was limited over this subgrade. A conventional design was compared to an alternative design as described in the present disclosure.

Figure 8:
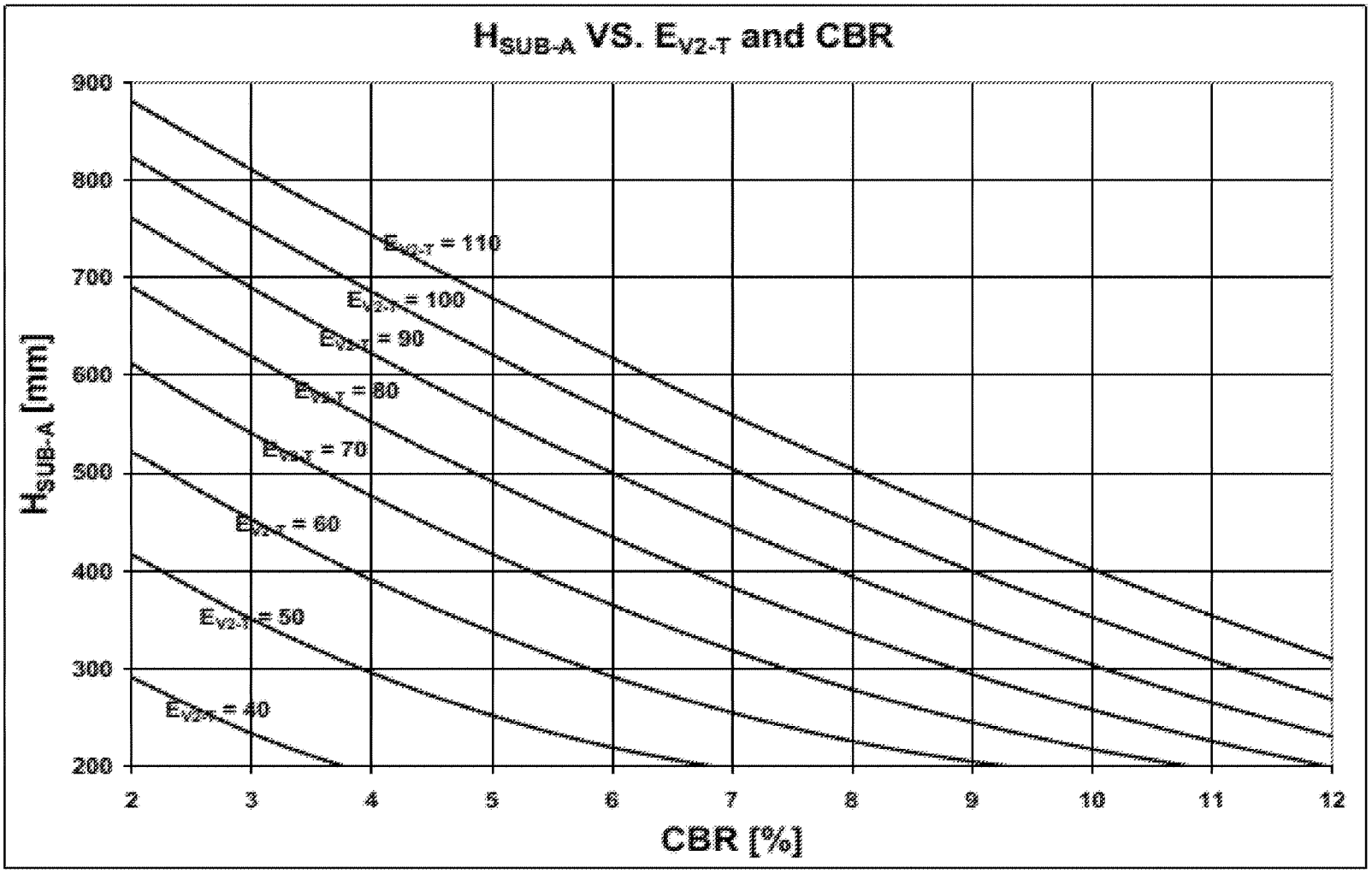
FIG. 8 is a graph showing the calculated thickness of the base layer ($H_{SUB-A}$) of a conventional unreinforced design as a function of the CBR of the subgrade to obtain a desired elastic modulus of the base layer ($E_{V2-T}$).

FIG. 8 is a graph showing the calculated thickness of the base layer ($H_{SUB-A}$) as a function of the CBR of the subgrade to obtain the desired elastic modulus of the base layer. For example, to obtain an elastic modulus of 100 kPa with a subgrade CBR of 3, the base layer will need to be 750 mm thick. This modulus is sufficient for conventional railway pavement design in Israel.

The conventional design was prepared by using sand or lime to stabilize the first 600 mm of the subgrade. Next, 920 mm of crushed stone was applied and compacted, and then 300 mm of gravel was applied and compacted. Ballast and railroad ties were then placed upon the pavement system.

The alternative design was designed as follows. The modulus of the combination of a geogrid-reinforced layer and a geocell-reinforced layer was measured separately in a model pavement in which the layers were installed on a subgrade with a known CBR. Pressure cells were positioned below the geogrid layer. Increasing pressure was applied on top of the geocell layer by a plate or vehicle wheel until plastic (irreversible) deformation occurred. Based on the pressure drop curve, the layer modulus was back-calculated. Based on the plastic deformation after a series of repeated loading, the degree of "immunity" to prolonged stresses was evaluated.

In the field, the alternative design was prepared by first leveling the subgrade. A first geogrid layer was applied and covered by a crushed stone layer of 200 mm thickness. A first geocell layer was then applied over the crushed stone layer. The first geocell layer was 150 mm high, and geocells had 330 mm distance between seams. The infill material was crushed stone. A secondary granular layer of 50 mm thickness was then applied over the first geocell layer, and a second geocell layer of the same construction as the first geocell layer was applied. Ballast and railroad ties were then placed upon the second geocell layer.

The difference in required materials was very apparent between the two designs. The conventional design required processing of 600 mm with sand or lime, followed by 1220 mm of granular materials. In contrast, the alternative design required only 750 mm of granular materials, providing a large cost savings.

A one-year study of the performance of the two designs was conducted in Israel. The conventional design suffered from plastic distortions that continuously increased over time. The result was slower train speeds and maintenance being required at short intervals. The alternative design, using a geogrid and two geocell layers, showed pure elastic performance with no irreversible distortions.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A pavement system to be installed over a weak subgrade having a California Bearing Ratio (CBR) of 4 or lower, comprising:

a first geogrid layer placed on the subgrade and made of at least one geogrid, each of said at least one geogrid being made from rib members that intersect to form geogrid apertures;

a first granular layer placed upon the first geogrid layer and comprising a first granular material, the first granular layer having an average thickness of from 0.5 times to 20 times an aperture distance of the first geogrid layer;

a first geocell layer placed upon the first granular layer and comprising at least one geocell that is filled with an infill material, the first geocell layer having a cell size of from about 200 millimeters to about 600 millimeters;

a second geocell layer or a second geogrid layer placed over the first geocell layer; and optionally, a capping layer made from a compacted second granular material, wherein the optional capping layer is placed over the second geocell layer or the second geogrid layer.

2. The pavement system of claim 1, further comprising a surface layer placed over the second geocell layer or the optional capping layer, the surface layer comprising asphalt or concrete or ballast or granular material.

3. The pavement system of claim 1, wherein the first granular material is sand, gravel, or crushed stone.

4. The pavement system of claim 1, wherein the first granular material also enters the geogrid apertures of the first geogrid layer.

5. The pavement system of claim 1, wherein the infill material comprises sand, crushed stone, gravel, recycled asphalt pavement (RAP), quarry screenings, or mixtures thereof.

6. The pavement system of claim 1, wherein the second granular material of the capping layer comprises sand, gravel, or crushed stone.

7. The pavement system of claim 1, wherein the aperture distance is from about 10 millimeters to about 500 millimeters.

8. The pavement system of claim 1, wherein the first geocell layer has a cell height of from about 50 millimeters to about 300 millimeters.

9. The pavement system of claim 1, wherein each of said at least one geogrid is made of a polypropylene, polyethylene, polyester, polyamide, aramids, carbon fiber, textile, metal wire or mesh, glass fiber, fiber-reinforced plastics, multilayer plastic laminates, or polycarbonate.

10. The pavement system of claim 1, wherein the first granular material has a higher average particle size than the infill material.

11. The pavement system of claim 1, further comprising a secondary granular layer comprising a third granular material and having a thickness of about 1 mm to about 300 mm, the secondary granular layer being located between (i) the first geocell layer and (ii) either the second geocell layer or the second geogrid layer.

12. A method for installing a pavement system over a weak subgrade having a California Bearing Ratio (CBR) of 4 or lower, comprising:

applying at least one geogrid to the subgrade to form a first geogrid layer, each of said at least one geogrid being made from rib members that intersect to form geogrid apertures;

applying a sufficient amount of a first granular material over the first geogrid layer and then compacting the first granular material to form a first granular layer that has an average thickness of from 0.5 times to 20 times an aperture distance of the geogrid layer;

placing at least one geocell upon the first granular layer;

filling the at least one geocell with an infill material to form a first geocell layer having a cell size of from about 200 millimeters to about 600 millimeters;

placing another geocell or geogrid over the first geocell layer to form a second geocell layer or a second geogrid layer;

optionally forming a capping layer upon the second geocell layer or the second geogrid layer by applying a second granular material over the second geocell layer or the second geogrid layer and compacting the second granular material, the capping layer having a thickness of zero to about 500 mm.

13. The method of claim 12, further comprising the step of applying a surface layer over the capping layer, the surface layer comprising asphalt or concrete or ballast or granular material.

14. The method of claim 12, further comprising removing soil to expose the weak subgrade.

15. The method of claim 12, wherein the first granular material and the second granular material are independently sand, gravel, or crushed stone.

16. The method of claim 12, wherein the first granular material also enters the geogrid apertures of the geogrid layer.

17. The method of claim 12, wherein the infill material comprises sand, crushed stone, gravel, or mixtures thereof.

18. The method of claim 12, wherein the second geocell layer or second geogrid layer is spaced apart from the first geocell layer by a distance of zero to about 500 mm.

* * * * *